US007911159B2

(12) United States Patent
Van Casteren et al.

(10) Patent No.: US 7,911,159 B2
(45) Date of Patent: Mar. 22, 2011

(54) ROBUST DRIVER FOR HIGH INTENSITY DISCHARGE LAMP

(75) Inventors: Dolf Henricus Jozef Van Casteren, Eindhoven (NL); Robertus Leonardus Tousain, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 766 days.

(21) Appl. No.: 11/718,010

(22) PCT Filed: Oct. 24, 2005

(86) PCT No.: PCT/IB2005/053482

§ 371 (c)(1),
(2), (4) Date: Dec. 14, 2007

(87) PCT Pub. No.: WO2006/046199

PCT Pub. Date: May 4, 2006

(65) Prior Publication Data

US 2008/0185980 A1 Aug. 7, 2008

(30) Foreign Application Priority Data

Oct. 29, 2004 (EP) ..... 04105401

(51) Int. Cl.
*H05B 41/36* (2006.01)
*H05B 39/04* (2006.01)

(52) U.S. Cl. ..... 315/308; 315/307

(58) Field of Classification Search ..... 315/307, 315/308, 224, DIG. 5
See application file for complete search history.

(56) References Cited

U.S. PATENT DOCUMENTS

| | | | | |
|---|---|---|---|---|
| 4,485,434 | A | 11/1984 | Beeston et al. | |
| 5,910,713 | A | 6/1999 | Nishi et al. | |
| 6,396,725 | B1 * | 5/2002 | Jacobs et al. | 363/131 |
| 6,525,491 | B2 * | 2/2003 | Huber et al. | 315/291 |
| 6,967,449 | B2 * | 11/2005 | Ishihara et al. | 315/307 |
| 2004/0189217 | A1 | 9/2004 | Ishihara et al. | |

FOREIGN PATENT DOCUMENTS

| | | | |
|---|---|---|---|
| EP | 1309229 | A2 | 5/2003 |
| WO | WO9535645 | A1 | 12/1995 |
| WO | 2004045255 | A2 | 5/2004 |

* cited by examiner

*Primary Examiner* — Douglas W Owens
*Assistant Examiner* — Minh D A

(57) ABSTRACT

A circuit arrangement and a method for operating a high intensity discharge lamp driver, which assure long-lasting stable operation of a high intensity discharge lamp regardless of the type or the age of the lamp. This is achieved by the determination of a correctional setpoint signal for a given time period based on the a difference signal between a principal setpoint signal and the actual output current signal for a given time period. The principal setpoint signal is then adjusted by the determined correctional setpoint signal.

32 Claims, 4 Drawing Sheets

ROBUST DRIVER FOR HIGH INTENSITY DISCHARGE LAMP

The invention relates to a circuit arrangement for operating a high intensity discharge lamp.

Such a circuit arrangement is known as a lamp ballast and is for instance used to operate high intensity discharge (HID) or ultra high pressure (UHP) lamps. In a known fashion, a current having a square-wave time dependency is supplied to the UHP lamp, leading to the electrodes of the lamp functioning alternatingly as a cathode and as an anode during successive half-periods of the lamp current. As a result, premature erosion of one of the electrodes is prevented. To produce such a square wave current, circuits for operating HID lamps often employ a commutator comprising a full bridge circuit.

Each commutation of the lamp current can lead to a transient behavior, caused by the interaction of the lamp and the circuit. This so-called ringing of the lamp current leads to visible disturbances of the light output of the lamp.

Existing lamp drivers use a feed forward control to shape the current. The current waveform is recorded in look-up tables in a μ-processor memory. This recorded waveform is tuned empirically for every lamp-ballast combination to achieve a stable lamp current. However, lamp dynamics undergo large variations during the lifetime of the lamp. Accordingly, a feedforward control with look-up tables cannot guarantee satisfactory performance throughout the lamp's life-span. Also, for a broad lamp family, an equal number of dedicated lamp ballasts are required, because for every lamp-ballast combination the μ-processor tables must be tuned empirically. The same holds for a feedback control, since its control performance will degrade more and more with increasing difference between the actual and the assumed lamp dynamics.

Arc stabilization in HID lamps is usually achieved by a so-called arc "flatter" pulse operation. A drawback of HID lamps operated in pulse mode is that they do not deliver a constant light. For projection applications a constant or well-defined light level is required. The lamp current, power, and related light are normally not stable and undercritically damped.

Because of the strongly varying dynamics of the system to be controlled, typical feedforward or feedback control schemes are severely limited in their performance and can guarantee this performance level for a short fraction of the lifetime of a high intensity discharge lamp and one particular lamp type, only.

Accordingly, a lamp ballast system and a method for operating such a system is needed that produces a stable lamp current in accordance with a setpoint signal for a large variety of lamps during a long portion or even the entirety of their life-span. This is achieved by a circuit arrangement and a method in accordance with the present invention.

A circuit arrangement for operating a high intensity discharge lamp in accordance with the invention comprises regulable converter means adapted to generate a current regulable in magnitude out of a supply voltage, commutator means for commutating the current and comprising lamp connection terminals, setpoint signal generator means adapted to generate a principal setpoint signal for the current, and correctional setpoint signal generator means adapted to generate a correctional setpoint signal adjusting the principal setpoint signal to form a corrected setpoint signal. The correctional setpoint signal generator means comprises memory means, output means for the correctional setpoint signal, input means adapted to acquire an input signal, and calculation means adapted to periodically recalculate the correctional setpoint signal based on the input signal and a signal stored in the memory means. The circuit arrangement furthermore comprises phase synchronization means adapted to synchronize the correctional setpoint signal generator to the principal setpoint signal. In another preferred embodiment, a method for operating a high intensity discharge lamp driver is disclosed. A method according to another preferred embodiment comprises: generation of a principal setpoint signal for a given time period; acquisition of a signal corresponding to an actual output current for the given time period; determination of a difference signal between the principal setpoint signal and the actual output current signal for the given time period; determination of a correctional setpoint signal for a subsequent time period of the given time period based on the difference signal; and adjustment of the principal setpoint signal with the correctional setpoint signal for the subsequent time period.

This disposition allows for correction of the principal setpoint signal that is applied to a plant, i.e. the system that shall be controlled. The output signal of the plant is the signal that is intended to be controlled with respect to the principal setpoint signal. The circuit arrangement according to the invention competes with feedforward control loops and feedback control loops. Advantages of feedforward control loops are their fastness, low complexity and cost. Drawbacks are the poor control results, especially if disturbances are present or system dynamics vary, which is the case in the present application. Feedback control loops can handle disturbances at the output of the controlled system, but still suffer from poor control results in case of varying system dynamics. Feedback control loops are further subject to the condition that they need to be able to handle a high bandwidth, in other words they need to be fast. The present invention has a feedforward control loop as the basic structure. In the concerned field of application of lamp drivers for high intensity discharge lamps, varying system dynamics are a major problem. In order to add robustness to the feedforward control of the lamp current, a correctional setpoint signal is determined, which modifies the principal setpoint signal. This is done in such a way that the corrected setpoint signal resulting from the application of the correctional setpoint signal to the principal setpoint signal excites the controlled system in an optimal manner, which means that, although the excitation signal for the controlled system, i.e. the corrected setpoint signal, may significantly vary from the principal setpoint signal, the output of the controlled system will be close or even identical to the principal setpoint signal. For a circuit arrangement or method according to the invention, the high intensity discharge lamp is part of the controlled system. More particularly, the high intensity discharge lamp forms a dynamic system together with components of the circuit arrangement. In particular, a combination of a high intensity discharge lamp and components of the circuit arrangement can be characterized by second order resonant dynamics. The components of the circuit arrangement that are most susceptible to contribute to the observed dynamic behavior are the converter means and an igniter for the high intensity discharge lamp, which is usually part of the commutator means, since both comprise energy storages (capacitors and/or inductances). The system is driven by a converter in accordance with the corrected setpoint signal. Therefore, the converter has to be regulable with respect to the corrected setpoint signal, which means that the converter produces a current, that is regulable in magnitude. Within the capabilities of the converter, this magnitude can be changed more or less quickly, so that almost arbitrary current evolutions can be generated, as long as the current remains positive. Commutator means are provided to inverse the direction of the current. The converter means and the commutator means can be separate or integrated one with the other. The converter means can be a DC-to-DC converter means or an AC-to-DC converter means. The commutator inverses the direction of the current periodically. A combination of converter means and commutator means can therefore be regarded as a DC-to-AC converter or an AC-to-AC converter. Two setpoint signal generators are provided in the circuit arrangement: a principal and a correctional setpoint signal generator. Each setpoint signal generator produces a corresponding setpoint signal. The principal setpoint signal is a repeating signal with a specific period. The correctional setpoint signal is more complicated, since it is periodically recalculated by the correctional setpoint signal generator. To account for this, the correctional setpoint signal generator comprises calculation means. Since the recalculation of the correctional setpoint signal is based on the input signal and a stored signal, the correctional setpoint signal generator also has input means and memory means. The input means allow the correctional setpoint signal generator to acquire signals from other components. The memory means allow the correctional setpoint signal generator to calculate the correctional setpoint signal as a function of signals of the present and the past. Common non-volatile memory technologies such as ROM, PROM, EPROM, and EEPROM can be used as a non-volatile part of the memory means. These non-volatile memories are programmed e.g. either during the die process of the semiconductor or by flash programming. Another part of the memory means is updateable so that also volatile memories, such as RAM, SRAM, or DRAM may be used. In the circuit arrangement, phase synchronization means allow the correctional setpoint signal to be synchronized to the principal setpoint signal generator, which is important for a proper function of the circuit arrangement. In fact, since the correctional setpoint signal is intended to correct the principal setpoint signal, it must be applied to the latter so that corresponding portions of both signals appear simultaneously.

In a related embodiment, the signal stored in the memory means is the correctional setpoint signal of a current period, the correctional setpoint signal generator thus being adapted to perform an iterative calculation of the correctional setpoint signal. An iterative calculation of the correctional setpoint signal is advantageous, because results obtained during previous periods provide a good guess for further improvements to the correctional setpoint signal. During a prior period, a signal of that prior period was therefore temporarily stored in the memory means, until it is used for calculation during the present period.

In one embodiment, the memory means store update matrices $L_u$ and $L_y$ for the iterative calculation. Update matrices $L_u$ and $L_y$ are used to determine the respective contribution of the past and the presence in an iterative calculation.

In one embodiment, the calculation means are adapted to accept as input: the correctional setpoint signal of the current period from the memory means, and an average signal of an actual output current from the memory means, the actual output current being the current flowing through the high intensity discharge lamp and corresponding to the input signal to the input means, and the average signal being calculated by superposing the actual output current signal of at least one of the current period and one or more prior periods. In terms of an embodiment of a method according to the invention, the iterative determination is a function of the principal setpoint signal of a the given time period, the principal setpoint signal adjusted by the correctional setpoint signal of the given time period, an average signal of an actual output current flowing through the high intensity discharge lamp, the average signal being calculated by superposing and scaling the actual output current signal of at least one of said given time period and one or more prior periods. This allows the calculation means to use the correctional setpoint signal of the prior period and the average signal of the actual output current for the iterative calculation. The average signal of the actual output current is more stable than the signal of the actual output current of only one period, which would lead to larger fluctuations during the convergence process of the iterative calculation. The average signal is also a signal with the length of one period. It is determined by adding the signals of the actual output current for all periods that shall be considered and then dividing by the number of considered periods. It is therefore different from the average value of the output current over these periods, which would be single number.

In one embodiment of the present invention, the circuit arrangement further comprises a summing point adapted to add the principal setpoint signal and the correctional signal to form the corrected setpoint signal. The controlled system can be considered to be roughly linear. Therefore, superposition of input signals will lead to the superposition of output signals. Accordingly, the correctional setpoint signal can be determined such that it cancels out unwanted signals at the output of the controlled system, i.e. in the actual output current. Furthermore, a summing point is easy to implement in both analogue and digital environments.

In one embodiment of the present invention, the calculation means are adapted to calculate a difference signal of the principal setpoint signal and the signal corresponding to the actual output current. The difference signal of the principal setpoint signal and the signal corresponding to the actual output current is the control deviation signal and indicates the quality and performance of the control. It also contains valuable information for the calculation of the next correctional setpoint signal. Since this difference signal represents unwanted components in the actual output current signal, the correctional setpoint signal can be adjusted to attempt to nullify these components.

In a related embodiment, the principal setpoint signal, the correctional setpoint signal, the signal corresponding to said actual output current, and the signal stored in the memory means, or a memory, are respectively represented by a discrete sequence of said principal setpoint signal, a discrete sequence of the correctional setpoint signal, a discrete sequence of the signal corresponding to the actual output current, and a discrete sequence of the signal stored in the memory means. Each discrete sequence represents the respective signal by means of a plurality of values, and each value corresponds to an instantaneous value of the respective signal at a particular instance. By using discrete representation for the various continuous signals that are present in the circuit arrangement, the iterative calculation can be performed digitally. Furthermore, discrete sequences can be more easily stored than continuous signals. If the discretisation, and accordingly the span of time between two consecutive discrete samples of a signal, is small enough, the discrete sequence can be regarded as an accurate representation of the signal, so that no loss of accuracy has to be feared. Conversion of a continuous signal to a discrete sequence is usually performed by a so-called sample-and-hold circuit.

In a related embodiment, the iterative calculation performed by the calculating means obeys the equations $$\Delta U_k = L_y(R_k - Y_k) + L_u U_k$$

$$U_{k+1} = U_k + \Delta U_k$$

with, for a k-th period, $\Delta U_k$ being the discrete sequence of a variation of the correctional setpoint signal, $R_k$ being the discrete sequence of the principal setpoint signal, $Y_k$ being the discrete sequence of the actual output current, $U_k$ and $U_{k+1}$ being a discrete sequence of said correctional setpoint signal of said k-th period and a subsequent period k+1, respectively, the update matrix $L_y$ being an operator for a sequence of the difference signal between $R_k$ and $Y_k$, and the update matrix $L_u$ being an operator for the sequence of the correctional setpoint signal. In this update law for the sequence of the correctional setpoint signal, two matrix-vector multiplications are performed. The first multiplication concerns the control deviation, which is represented by $(R_k - Y_k)$. The matrix $L_y$ is multiplied with the discrete representation of the control deviation signal. The second matrix-vector multiplication concerns the correctional setpoint signal of the k-th period. Both products, which are vectors again, are added in order to yield the variation of the correctional setpoint signal vector. Update matrices $L_u$ and $L_y$ are therefore an iteration gain and an error gain, respectively. A new correctional setpoint signal is calculated for the next period k+1 from the sum of the correctional setpoint signal vector in period k and the determined variation of the correctional setpoint signal vector. Although the iteration law could be written in a single equation, the proposed definition of the iteration law is a notation that is easy to comprehend.

In a further related embodiment, the update matrices $L_y$ and $L_u$ are determined from an estimation of system dynamics. In a corresponding embodiment of a method according to the invention, the iterative determination is a function of an estimation of a dynamic of a controlled system, the system comprising the high intensity discharge lamp, a converter and a commutator. In one embodiment, the iterative determination further is a function of a combination of a plurality of empirically determined system dynamics. One objective of the proposed control scheme is to predict the system behavior to specific excitations to a certain extent so that countermeasures to undesired reactions of the system can be performed well timed. This requires the knowledge of at least an approximation of the system behavior. Such an approximation can be obtained prior to producing the lamp drivers by evaluating a representative selection of lamps. The representative selection of lamps can include different lamp types at different ages. The system dynamics of each lamp in the representative selection is estimated and influences the iteration law. Accordingly, several estimations of the systems dynamics are used to calculate the update matrices $L_y$ and $L_u$, which is usually, but not necessarily, also performed offline. The update matrices have then been stored to the memory means of the correctional setpoint signal generator in a permanent manner for example during the production of the circuit arrangement. Therefore, the estimation of the system dynamics should be representative for the majority of dynamic systems that will be possibly encountered. But even if the estimated system dynamics do not exactly match those of the actual system, the control scheme of the present invention will still react in a robust manner due to the iterative update law. As long as the actual system dynamics are at least similar to those which were used to determine the update matrices Ly and Lu, the actual output current will still converge to the principal setpoint. This makes the lamp driver in form of the proposed circuit arrangement very insensitive to the type of HID lamp, its age, and other factors having an influence on the dynamics of the system. Therefore, the lamp driver is compatible to a wide range of HID lamps and maintains its control performance throughout the lifetime of the HID lamp. As an alternative to an estimation of the system dynamics in advance, it is also possible to perform the estimation in-situ, i.e. in the circuit arrangement itself. This can be done by exciting the system with a predefined signal and analyzing the response of the system.

In one embodiment, the memory means are adapted to store a feedforward table containing the correctional setpoint signal sequence corresponding to one period. In a corresponding method embodiment, the correctional setpoint signal sequence corresponding to one period is stored in a feedforward table. The feedforward table is adapted to work together with the output means of the correctional setpoint signal generator so that a sequence in the feedforward table is written sample for sample to the output means.

In one embodiment, the setpoint signal generator is adapted to generate a periodically repeating signal. A periodically repeating signal generated by the principal setpoint generator allows an efficient prediction of the principal setpoint signal, since the dynamic response of the system can be watched and analyzed over several periods. This allows the iterative calculation to converge by gradually attempting to improve the system response.

In one embodiment, the controlled system further comprises a subsidiary feedback control. In a related embodiment, the subsidiary feedback control comprises a voltage feedback and/or a current feedback. Having a subsidiary feedback control is an advantage, if a disturbance appears at the system output, which does not persist for several consecutive periods, but sporadically. It therefore escapes from being annulled by the correctional setpoint signal, because before convergence is achieved, it has already disappeared. A subsidiary feedback control can take care of such a disturbance, since it does not depend on the periodicity of the setpoint signal and therefore will not wait for the next period to start canceling out the disturbance. A voltage and/or current feedback detects such a disturbance, which translates by a difference of the output voltage and/or current to the setpoint signal. For the subsidiary feedback control, the setpoint signal corresponds to the corrected control signal.

In another preferred embodiment, a high intensity discharge lamp driver comprises a circuit arrangement as defined above. Especially lamp driver can benefit from the proposed circuit arrangement, since it solves an important problem of lamp drivers for HID lamps, namely poor robustness of conventional lamp drivers with respect to varying lamp dynamics.

In a related embodiment, the circuit arrangement and/or the correctional setpoint signal generator is an add-on device for the high intensity discharge lamp driver. As an add-on device, no modification of the high intensity discharge driver is necessary. The add-on device can be used with a plurality of high intensity discharge driver types.

In one embodiment, the method comprises the steps of: measuring the system dynamics, storing the measured system dynamics, and deducting the update matrices $L_u$ and $L_y$ from the measured system dynamics. The system dynamics can be measured during operation of the HID lamp, for example by recording the step response of the system. An analysis with respect to characteristic properties is then be performed. From this, update matrices $L_u$ and $L_y$ can be determined. This has the advantage that the system dynamics that the update law will be based on, are substantially identical to the actual system dynamics, leading to improved performance of the method for controlling the actual lamp current. The range of admissible HID lamps to be operated using this method with a given lamp driver will be even larger.

In one embodiment, the differential sequence of the two sequences of the principal setpoint signal and the signal corresponding to the actual output current asymptotically approaches a zero-sequence. If the differential sequence approaches a zero-sequence, the signal corresponding to the actual output converges to the principal setpoint signal. It is therefore an indicator for the proper operation of the method for operating a HID lamp, which can be used as a signal to a user to warn him that the employed HID lamp is out of the specification of the lamp driver.

One embodiment of the present invention concerns a projection system comprising a high intensity discharge lamp and a circuit arrangement according to the above-given description. The combination of a high intensity discharge lamp, in particular those of the Ultra High Pressure (UHP) type often used in projection systems, with a circuit arrangement as described above is suitable for projection systems due to the high stability of the light output. This leads to a nearly flicker-free operation of the projection system, and consequently contributes to a stable appearance of the projected image. The long-term stability of the light output is also improved so that necessary replacements of the high intensity discharge lamp become less frequent.

By way of example, embodiments of a circuit arrangement and a method according to the invention will be explained and making reference to the accompanying drawings. In the drawings FIG. 1*a* shows a feedforward control loop according to the prior art;

FIG. 1*b* shows a feedback control loop according to the prior art;

Figure 1A:
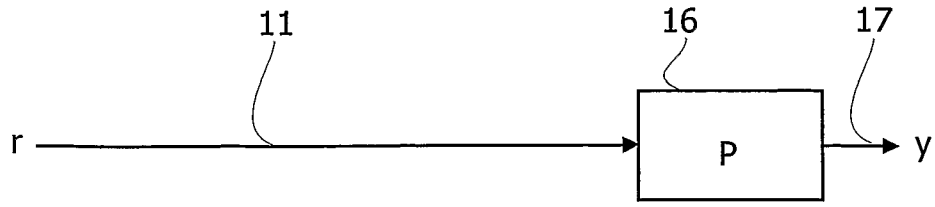

FIG. 1*a* shows a feedforward control of a system, or plant 16 (P). A reference signal r is applied directly to the plant 16, which responds according to its system dynamics with a system output signal y. In the represented case, the control signal that is applied to the plant 16 is identical to the reference signal r. If the system output y is required to follow a specific time dependency, the reference signal r and consequently the control signal must anticipate the plant's dynamic behavior. The reference input has the numeral 11, and the system output has the numeral 17. Instead of anticipating the plant's dynamic behavior in the reference signal r already, a feedforward controller may be provided at the input to the system (not represented). This feedforward controller modifies the reference signal in accordance with the system dynamics to produce a control signal for application to the input of the system. Ideally, the feedforward controller nullifies the system dynamics. However, a feedforward controller being a causal system can only respond to the reference signal.

Figure 1B:
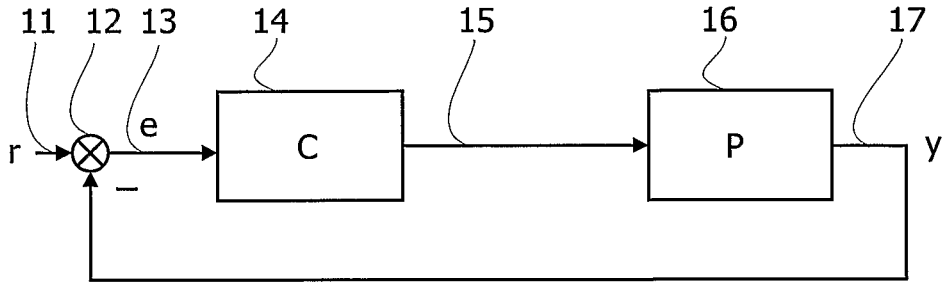

FIG. 1*b* shows a feed-back control according to the prior art. The feed-back control loop comprises the reference input 11 for the reference signal r, a summing point 12 determining the difference between the reference signal r and the system output y, a controller input 13 passing the control deviation to a controller 14 (C). The output of controller 14 is connected via control signal line 15, transmitting the control signal to the input of the plant 16. The system output signal y is again present on the system output 17. Controller 14 attempts to bring the control deviation e at its input 13 to zero by adjusting control signal. Depending on the complexity of the plant 16 this objective can be achieved more or less quickly. A control deviation e equal to zero means that the system output y follows exactly the reference signal r.

Figure 2:
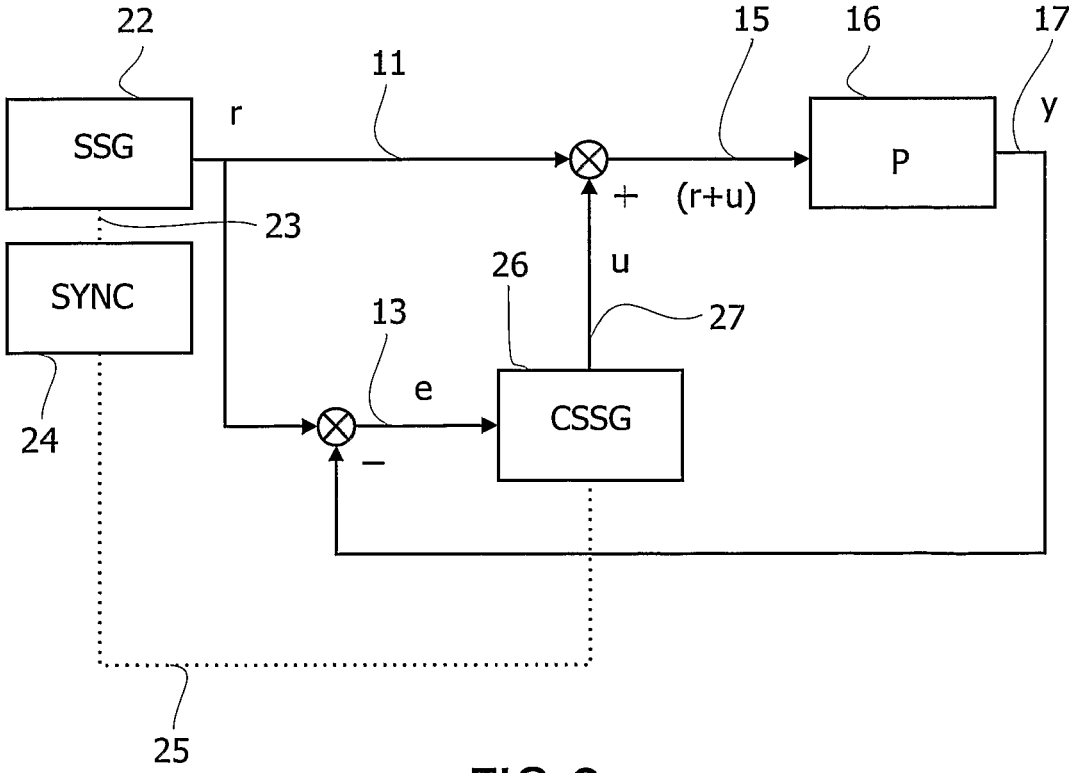
FIG. 2 shows the control scheme of the present invention.

FIG. 2 shows the control scheme of the present invention implemented in connection with a circuit arrangement for supplying a high intensity discharge lamp with a square wave shaped current and comprising a converter and a commutator. A setpoint signal generator (SSG) 22 generates a reference signal r, also known as setpoint signal. For better distinction, this setpoint signal will be referred to as principal setpoint signal. It is applied to a summing point. Another input to the summing point is the correctional setpoint signal u. The sum of principal setpoint signal r and correctional setpoint signal u yields the control signal which is present on the connection 15 between the summing point and the plant 16. It is easily appreciated that, if the correctional setpoint signal u is zero, only the principal setpoint signal r will be applied to the plant 16 as control signal. In this special case, the control scheme of FIG. 2 is similar to that of FIG. 1*a*. In the general case, however, the correctional setpoint signal u will be different from zero. It is determined in a correctional setpoint signal generator (CSSG) 26. The correctional setpoint signal generator 26 is connected to one of the inputs of the above-mentioned summing points via connection 27. The input to the correctional setpoint signal generator 26 is the control deviation e on the connection 13 between a second summing point and the correctional setpoint signal generator 26. The correctional setpoint signal generator 26 is capable of producing a correctional setpoint signal u that is predetermined for a certain period of time. In other words, a stored signal is played back during that period of time. A synchronizer (SYNC) 24 assures the synchronization between the setpoint signal generator and the correctional setpoint signal generator. Precise synchronization between the principle setpoint signal r and the correctional setpoint signal u is crucial for the function of the control scheme. The synchronization signal of the synchronizer 24 to the setpoint signal generator 22 is transmitted via connection 23, while the synchronizing signal from the synchronizer 24 to the correctional setpoint signal generator 26 is transmitted via connection 24. The correctional setpoint signal generator 26 comprises a memory, an analogue or digital output, an analogue input port and a calculator. The input port is connected to connection 13 and acquires the control deviation e. In a sample-and-hold manner the input port acquires the instantaneous value of the control deviation e at a plurality of instance during one time period. This leads to a discrete sequence of samples of the control deviation signal e, which can be stored in the memory of the correctional setpoint signal generator 26. In an inverse manner, the output port of the correctional setpoint signal generator 26 leads to a discrete sequence of samples of the correctional setpoint signal u and sends these samples successively over connection 27 to the summing point. During the time of one sample, the output port maintains a constant value for the correctional setpoint signal Δu, which leads to stepped evolution of the correctional setpoint signal over one period. The calculation of the correctional setpoint signal u is done for an entire period by the calculator. For this calculation, the input sequence of the control deviation e and the output sequence of the correctional setpoint signal u may be regarded as vectors having a length equal to the number of samples in one period. It may also be considered to calculate the correctional setpoint signal for a fraction of each period only. The output current experiences its strongest variations after a commutation event of the commutator, while in the remaining part of each period, the output current is relatively stable. Limiting the correctional setpoint signal to a part of each period around the commutation event(s) has the advantage that less calculations need to be performed and that less memory is required for storing the matrices. The vectors corresponding to the different signals will be designated by the corresponding capital letters so that $U_k$ is a vector containing the samples of the correctional setpoint signal u that belong to a period k. Similarly, $E_k$ designates the sequence of the control deviation in period k and $U_{k+1}$ designates the sequence for the corrected setpoint signal of the period k+1, which is one period after the period k. The iterative calculation performed by the calculator obeys the equation:

$$\Delta U_k = L_y(R_k - Y_k) + L_u U_k$$

$$U_{k+1} = U_k + \Delta U_k$$

This means that the correctional setpoint signal vector $U_k$ is calculated from the sum of two addends. The first addend depends on the control deviation which may also be expressed as $R_k - Y_k$. This control deviation vector is modified by an update matrix $L_y$. The second addend depends on a vector containing the correctional setpoint signal. This second addend represents the iterative opponent of the update law given by the above formula. Another first matrix $L_y$ is an operator for the control deviation vector $E_k = R_k - Y_k$. Another update matrix LI is an operator for the correctional setpoint signal vector $U_k$. Preferably those update matrices $L_y$ and $L_u$ reflect the dynamics of the plant 16, and are chosen such that the control deviation $E_k = R_k - Y_k$ eventually approaches a zero sequence, which means that the plant output exactly follows the principle setpoint. If the principle setpoint signal is a periodic signal, it may be considered to use also one or more of the prior periods in order to obtain an average sequence of the plant output signal, which in the present case is the actual lamp output current. If two periods k and k−1 are considered, this average sequence is determined by calculating the average of the first sample in period k and the first sample in period k−1, the average of the second sample in period k and the second sample in period k−, and so forth. The average sequence for the actual output current is more stable than a single sequence for the actual output current.

Figure 3:
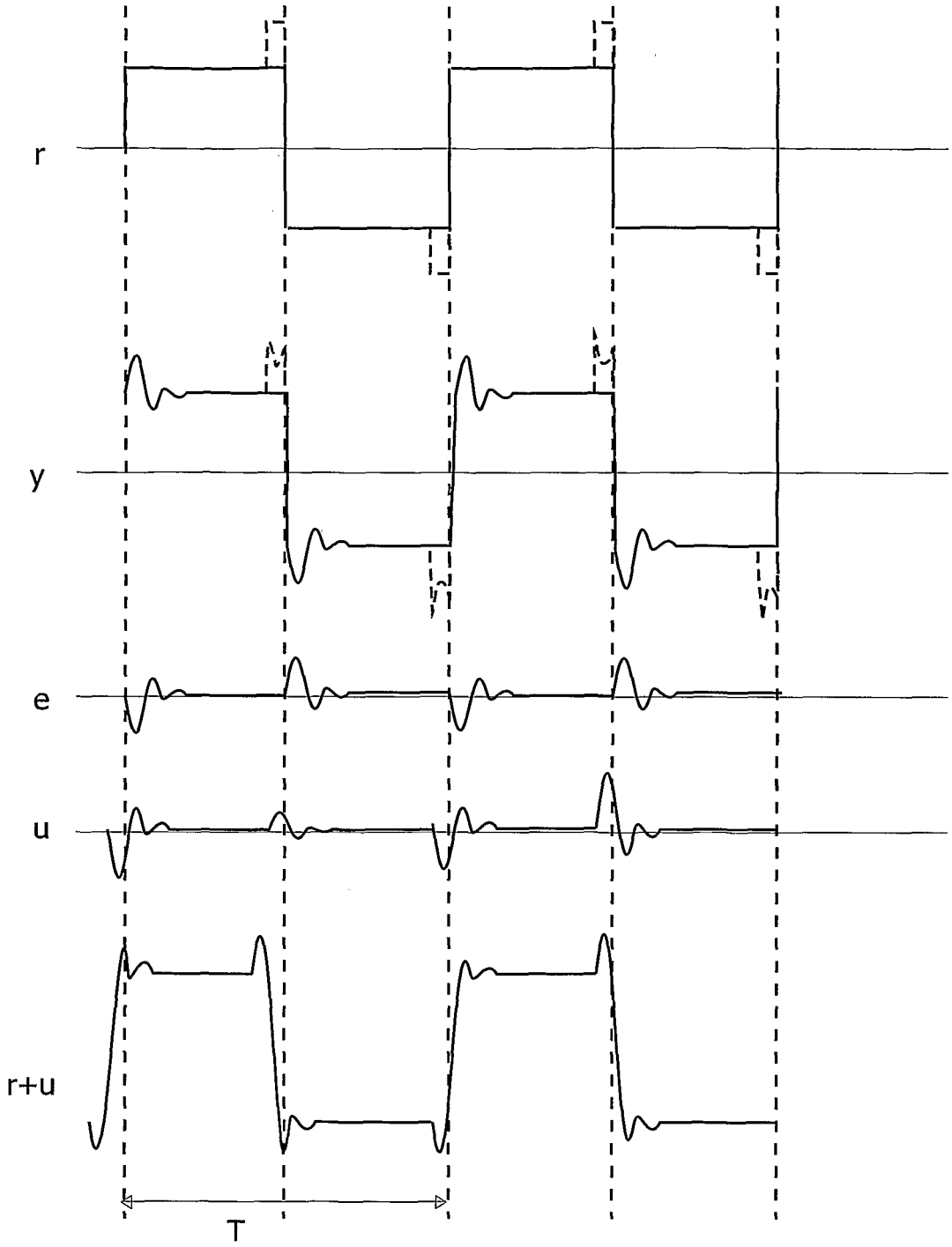
FIG. 3 shows various signals within the control scheme of FIG. 2 during two periods.

FIG. 3 shows the evolutions of five different signals during two periods of length T. The uppermost signal represents the principal setpoint signal r for the lamp current which has a mainly square-wave-like appearance. In gas discharge lamp applications, a lamp current with a substantially square-wave-like shape is preferred due to the lamp's lighting characteristics. Nevertheless, it may be advantageous to slightly depart from a perfect square wave in order to achieve an even more optimized lighting characteristic of an HID or UHP lamp. For example, it may be advantageous to increase the absolute value of the lamp current towards the end of every half-period, which renders the ark inside the gas discharge lamp more stable and therefore reduces flickering. This anti-flickering pulse is drawn as a dashed line. However, the present invention is not affected by the presence or the absence of such an anti-flickering current pulse or other modifications to the shape of the principle setpoint signal. As may be seen from the two consecutive periods, the principle setpoint signal is periodic.

The second signal in FIG. 3 is the plant output signal y. This corresponds to the actual lamp current. Instead of following the principal setpoint signal, the lamp current oscillates after each commutation of the principal setpoint signal. The frequency of the occurring oscillation, the response time, and the overshoot depend on the dynamics of the system. Again, the response to the anti-flickering pulse towards the end of each half-period is drawn as a dashed line.

The third signal in FIG. 3 represents the control deviation e, formed by the difference of r and y. The oscillations of the lamp current signal y are predominant in the control deviation e. It is the goal of the control scheme to bring this signal to zero.

The fourth signal in FIG. 3 is the correctional setpoint signal u. As explained above, this signal is determined for one period as a function of the control deviation e and a corrected setpoint signal of the previous period. Since the correctional setpoint signal u is supposed to attempt to anticipate the system behavior for a particular input signal, it may be also a function of the estimated system dynamics. The anticipating nature of the correctional setpoint signal u is reflected by the fact that a correctional setpoint signal u counteracts the expected undesired part of the system response by applying a counter signal to the input of the plant even before the principal setpoint signal reaches its commutation instant. This is possible, since the instant of the next commendation of the principal setpoint signal is known, due to the periodic nature of the principal setpoint signal r. In contrast, the correctional setpoint signal u is not periodic, so that it varies from one period to a next period, as long as the system has not converged. Depending on the convergence speed, the difference between a correctional setpoint signal u in one period to the same signal in an adjacent period is more or less large, and eventually vanishes.

The lower most signal in FIG. 3 presents the corrected setpoint signal r+u, which is determined as the sum of the principal setpoint signal r and the correctional setpoint signal u. Applying such a corrected setpoint signal r+u to the plant 16 gradually improves the plant output, i.e. the actual lamp current. After a few periods, the system should have converged so that from that instant on all signals will be substantially the same from one period to the next period.

Figure 4:
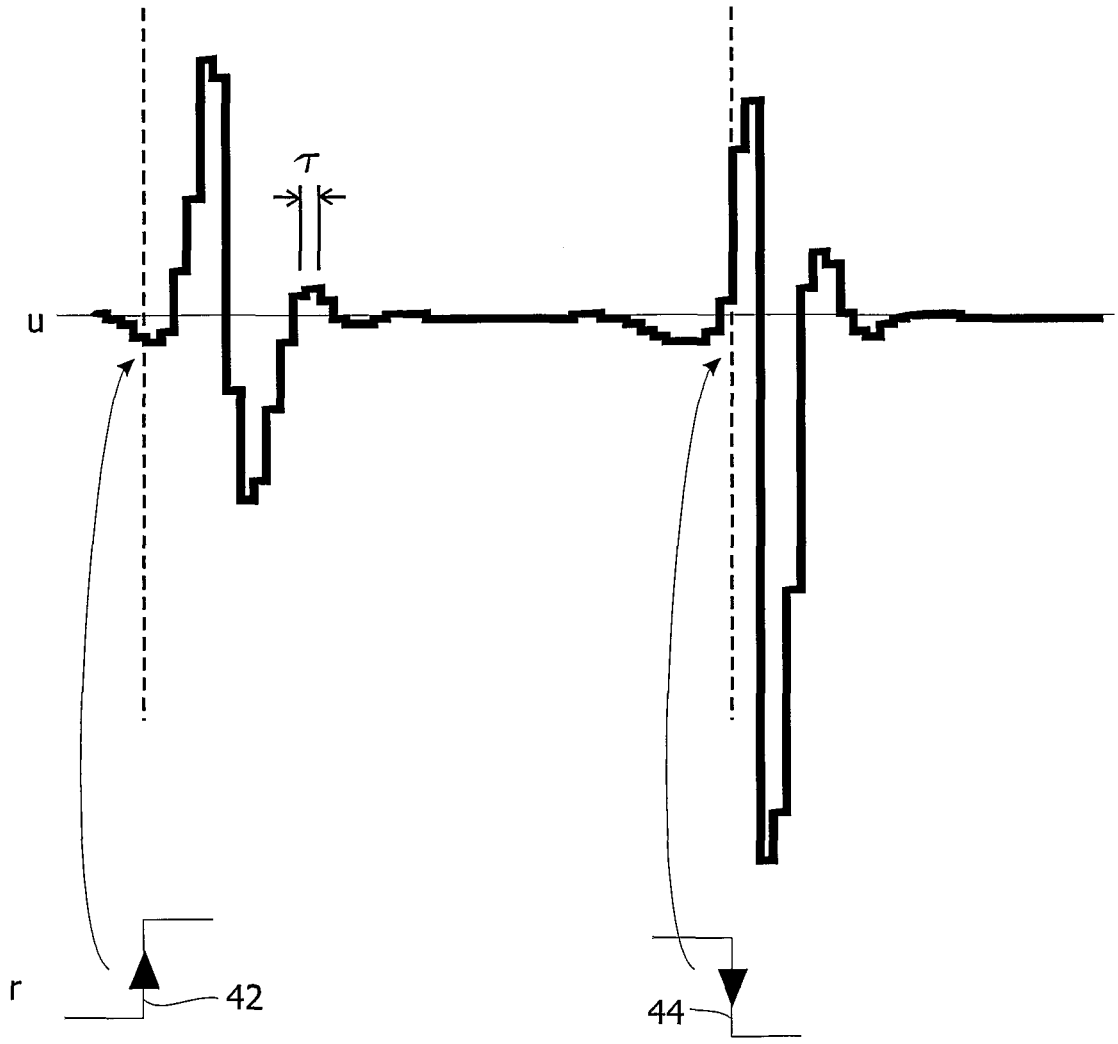
FIG. 4 shows a discrete correctional setpoint signal Δu.

Turning now to FIG. 4, a correctional setpoint signal u is shown for one period of length T. The correctional setpoint signal u is represented as a piecewise constant function. Inside the correctional setpoint signal generator 26 the correctional setpoint signal u is stored as a vector for one or more periods. The value corresponding to each element in that correctional setpoint signal vector is maintained for a duration $\tau$ which leads to this piecewise constant nature of the correctional setpoint signal u. The duration $\tau$ is also called sampling period. It can be seen that the correctional setpoint signal u shows particular activity in the vicinity of a rising edge 42 and a falling edge 44 of the principal setpoint signal r.

Figure 5:
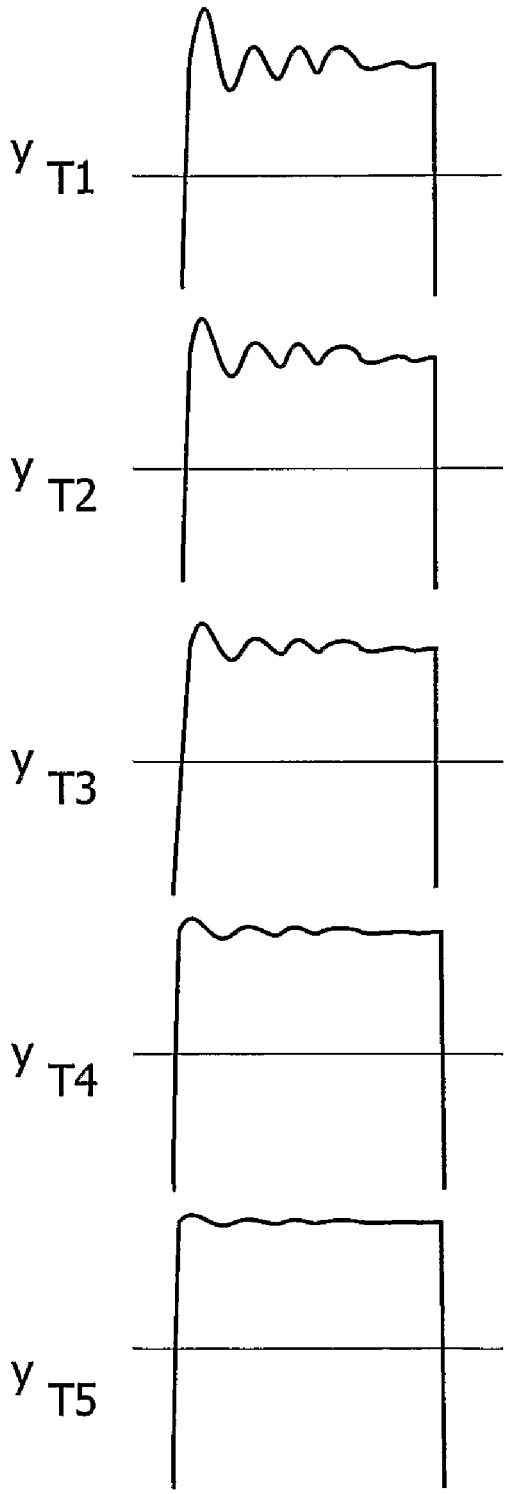
FIG. 5 shows five consecutive step responses of the system output.

In FIG. 5, five successive half periods are represented, all starting with a rising edge. Five consecutive periods T1, T2 . . . T5 are considered. While the actual lamp current signal in period T1, designated by $y_{T1}$, still shows large oscillations following the commutation, the oscillations gradually disappear over the following four periods. The signal $Y_{T5}$ in the fifth period T5 already shows a strong convergence compared to the signal $y_{T1}$ of period T1.

The invention claimed is:

1. Circuit arrangement for operating a high intensity discharge lamp, said circuit arrangement comprising regulable converter means adapted to generate a current regulable in magnitude out of a supply voltage, commutator means for commutating the current and comprising lamp connection terminals, setpoint signal generator means adapted to generate a principal setpoint signal for said current, correctional setpoint signal generator means adapted to generate a correctional setpoint signal adjusting said principal setpoint signal to form a corrected setpoint signal, said correctional setpoint signal generator means comprising memory means, output means for said correctional setpoint signal, input means adapted to acquire an input signal, and calculation means adapted to periodically recalculate said correctional setpoint signal based on said input signal and a signal stored in said memory means, and said circuit arrangement furthermore comprising phase synchronization means adapted to synchronize said correctional setpoint signal generator to said principal setpoint signal.

2. Circuit arrangement according to claim 1, wherein said signal stored in said memory means is said correctional setpoint signal of a current period, said correctional setpoint signal generator thus being adapted to perform an iterative calculation of said correctional setpoint signal.

3. Circuit arrangement according to claim 2, wherein said calculation means are adapted to accept as input:

said correctional setpoint signal of said current period from said memory means, and an average signal of an actual output current from said memory means, said actual output current being the current flowing through said high intensity discharge lamp and corresponding to said input signal to said input means, and said average signal being calculated by superposing and scaling the actual output current signal of at least one of said current period and one or more prior periods.

4. Circuit arrangement according to claim 1, wherein said memory means store update matrices $L_u$ and $L_y$ for said iterative calculation.

5. Circuit arrangement according to claim 4, wherein said calculation means are adapted to calculate a difference signal of said principal setpoint signal and said signal corresponding to said actual output current.

6. Circuit arrangement according to claim 5, wherein said principal setpoint signal, said correctional setpoint signal, said signal corresponding to said actual output current, and said signal stored in said memory means, are respectively represented by a discrete sequence of said principal setpoint signal, a discrete sequence of said correctional setpoint signal, a discrete sequence of said signal corresponding to said actual output current, and a discrete sequence of said signal stored in said memory means, each discrete sequence representing the respective signal by means of a plurality of values, each value corresponding to an instantaneous value of the respective signal at a particular instance.

7. Circuit arrangement according to claim 6, wherein said iterative calculation performed by said calculating means obeys the equations $$\Delta U_k = L_y(R_k - Y_k) + L_u U_k$$

$$U_{k+1} = U_k + \Delta U_k$$

with, for a k-th period, $\Delta U_k$ being a discrete sequence of a variation of said correctional setpoint signal, $R_k$ being a discrete sequence of said principal setpoint signal, $Y_k$ being a discrete sequence of said actual output current, $U_k$ and $U_{k+1}$ being a discrete sequence of said correctional setpoint signal of said k-th period and a subsequent period k+1, respectively, said update matrix $L_y$ being an operator for a sequence of said difference signal between $R_k$ and $Y_k$, and said update matrix $L_u$, being an operator for said sequence of said correctional setpoint signal.

8. Circuit arrangement according to claim 7, wherein said update matrices $L_y$ and $L_u$, are determined from an estimation of system dynamics.

9. Circuit arrangement according to claim 4, wherein said circuit arrangement further comprises a subsidiary feedback control.

10. Circuit arrangement according to claim 9, wherein said subsidiary feedback control comprises a voltage feedback and/or a current feedback.

11. Circuit arrangement according to claim 1, further comprising a summing point adapted to add said principal setpoint signal and said correctional signal to form said corrected setpoint signal.

12. Circuit arrangement according to claim 1, wherein said memory means are adapted to store a feedforward table containing said correctional setpoint signal sequence corresponding to one period.

13. Circuit arrangement according to claim 1, wherein said principal setpoint signal generator is adapted to generate a periodically repeating signal.

14. High intensity discharge lamp driver comprising a circuit arrangement according to claim 1.

15. High intensity discharge lamp driver according to claim 14, wherein said circuit arrangement is an add-on device.

16. High intensity discharge lamp driver comprising a circuit arrangement according to claim 1 as an add-on device.

17. Projection system comprising a high intensity discharge lamp and a circuit arrangement according to claim 1.

18. Method for operating a high intensity discharge lamp driver, said method comprising:

generation of a principal setpoint signal for a given time period;

acquisition of a signal corresponding to an actual output current for said given time period;

determination of a difference signal between said principal setpoint signal and said actual output current signal for said given time period;

determination of a correctional setpoint signal for a subsequent time period of said given time period based on said difference signal;

adjustment of said principal setpoint signal with said correctional setpoint signal for said subsequent time period.

19. Method according to claim 18, wherein said determination of said correctional setpoint signal is performed iteratively.

20. Method according to claim 19, wherein said iterative determination is a function of an estimation of a dynamic of a controlled system, said system comprising said high intensity discharge lamp, a converter and a commutator.

21. Method according to claim 20, wherein said iterative determination is a function of said principal setpoint signal of said given time period, said principal setpoint signal adjusted by said correctional setpoint signal of said given time period, an average signal of an actual output current flowing through said high intensity discharge lamp, said average signal being calculated by superposing and scaling the actual output current signal of at least one of said given time period and one or more prior time periods.

22. Method according to claim 21, wherein said iterative determination further is a function of a combination of a plurality of empirically determined system dynamics.

23. Method according to claim 22, wherein $L_y$ and $L_u$ are matrices determined from an estimation of system dynamics.

24. Method according to claim 22, wherein said correctional setpoint signal sequence corresponding to one period is stored in a feedforward table.

25. Method according to claim 22, wherein said controlled system further comprises a subsidiary feedback control.

26. Method according to claim 22, wherein said correctional setpoint signal generator is an add-on to common high intensity discharge lamp drivers.

27. Method according to claim 20, wherein said principal setpoint signal, said correctional setpoint signal, said signal corresponding to said actual output current, and a signal stored in a memory, are represented by a discrete sequence of said correctional setpoint signal, a discrete sequence of said principal setpoint signal, a discrete sequence of said signal corresponding to said actual output current, and a discrete sequence of said signal stored in said memory, respectively, each discrete sequence representing the respective signal by means of a plurality of values, each value corresponding to an instantaneous value of the respective signal at a particular instance.

28. Method according to claim 27, wherein a periodically repeating signal is generated by a setpoint signal generator.

29. Method according to claim 28, wherein said subsidiary feedback control comprises a voltage feedback and/or current feedback.

30. Method according to claim 27, wherein said differential sequence of said two sequences of said principal setpoint signal and said signal corresponding to said actual output current asymptotically approaches a zero-sequence.

31. Method according to claim 21, wherein said iterative determination obeys the equation $$\Delta U_k = L_y(R_k - Y_k) + L_u U_k$$

$$U_{k+1} = U_k + \Delta U_k$$

with, for a k-th period:

$\Delta U_k$ being a sequence of a variation of said correctional setpoint signal, $R_k$ being a sequence of said principal setpoint signal, $Y_k$ being a sequence of said actual output current signal, $U_k$ and $U_{k+1}$ being a discrete sequence of said correctional setpoint signal of said k-th period and a subsequent period k+1, respectively, $L_y$ being an operator for a sequence of said difference signal, and $L_u$, being an operator for said sequence of said correctional setpoint signal.

32. Method according to claim 31, further comprising the steps of:

measuring the system dynamics, storing said measured system dynamics, and deducting said operators $L_u$ and $L_y$ from said measured system dynamics.

* * * * *